United States Patent [19]

Kawakami

[11] 4,326,636

[45] Apr. 27, 1982

[54] APPARATUS FOR PROCESSING SHEETS

[75] Inventor: Moriatsu Kawakami, Tokyo, Japan

[73] Assignee: Laurel Bank Machine Co., Ltd., Tokyo, Japan

[21] Appl. No.: 131,822

[22] Filed: Mar. 19, 1980

[30] Foreign Application Priority Data

Mar. 20, 1979 [JP] Japan ..... 54-32809

[51] Int. Cl.[3] ..... B07C 5/08

[52] U.S. Cl. ..... 209/534; 209/583; 209/586; 209/541; 198/395; 198/400; 271/305

[58] Field of Search ..... 209/534, 583, 586, 587, 209/588, 540, 541, 900; 271/305; 235/92 SB, 379; 198/395, 400

[56] References Cited

U.S. PATENT DOCUMENTS 1,729,521 9/1929. Roddy ..... 209/900 X 3,800,155 3/1974 Potenza ..... 209/534 X

*Primary Examiner*—Allen N. Knowles

*Attorney, Agent, or Firm*—Fleit & Jacobson

[57] ABSTRACT

There is provided an apparatus for processing sheets. The apparatus comprises a feeding zone, a discriminating zone, a sorting zone and a stacking zone. The feeding zone includes rollers and guides for taking out sheets one at a time from a group of sheets in the stacked state and feeding them into a conveyor path. The discriminating zone includes a plurality of sensors for detecting positions, a magnetic pattern and a photo-pattern to discriminate the sheets. The sorting zone includes angularly rotatable forks for sorting the sheets according to their kinds in response to the signals from the discriminating zone. The stacking zone includes containers for stacking the sheets sorted by the sorting zone.

7 Claims, 3 Drawing Figures

PHRT
PHBK
PHS3
PHOT
PHS2
PHIM
PHS1
PHFCK
PHNF
PHL
PHPT
MGPT
PHLC
LS
LS
LS

APPARATUS FOR PROCESSING SHEETS

BACKGROUND OF THE INVENTION

This invention relates to an apparatus for processing sheets such as bank notes into normal notes (obverse), normal notes (reverse), abnormal notes, and notes of different kinds.

The conventional apparatus (such as disclosed in Japanese Utility Model Publication 17839/1978) stacks bank notes of a set kind irrespective of the obverse and reverse sides of the notes and then bundles them by predetermined numbers. In checking them again manually, therefore, the patterns on the obverse and reverse sides of the notes appear at random, thereby making the checking procedure difficult and inefficient. When it is desired to bundle the bank notes with both sides arranged back-to-front, their sides must be brought into coincidence manually by first untying the roll of notes, thus making the work extremely complicated.

SUMMARY OF THE INVENTION

It is, therefore, an object of the present invention to provide an apparatus for processing a group of sheets which not only classifies them into sheets of a set kind, those of different kinds and those which can not be identified, but also classifies them according to their obverse and reverse sides, in order to make it possible to efficiently carry out the manual re-confirmation work of the stacked sheets of the set kind.

There is provided an apparatus for processing sheets which comprises a feeding zone for taking out sheets one at a time from a group of sheets in the stacked state and feeding them into a conveyor path, a discriminating zone disposed in said conveyor path for discriminating the group of sheets according to the obverse side of the sheets of a set kind, the reverse side of the sheets of the set kind, sheets of different kinds and sheets of such a kind that can not be discriminated, a sorting zone actuated in response to signals from said discriminating zone for sorting the sheets of each of said kinds, and a stacking zone for stacking the sheets sorted by said sorting zone.

DESCRIPTION OF THE DRAWINGS

Other objects and advantages of the present invention will become apparent from the following description made with reference to the accompanying drawings, in which.

DESCRIPTION OF THE PREFERRED EMBODIMENT

Figure 1:
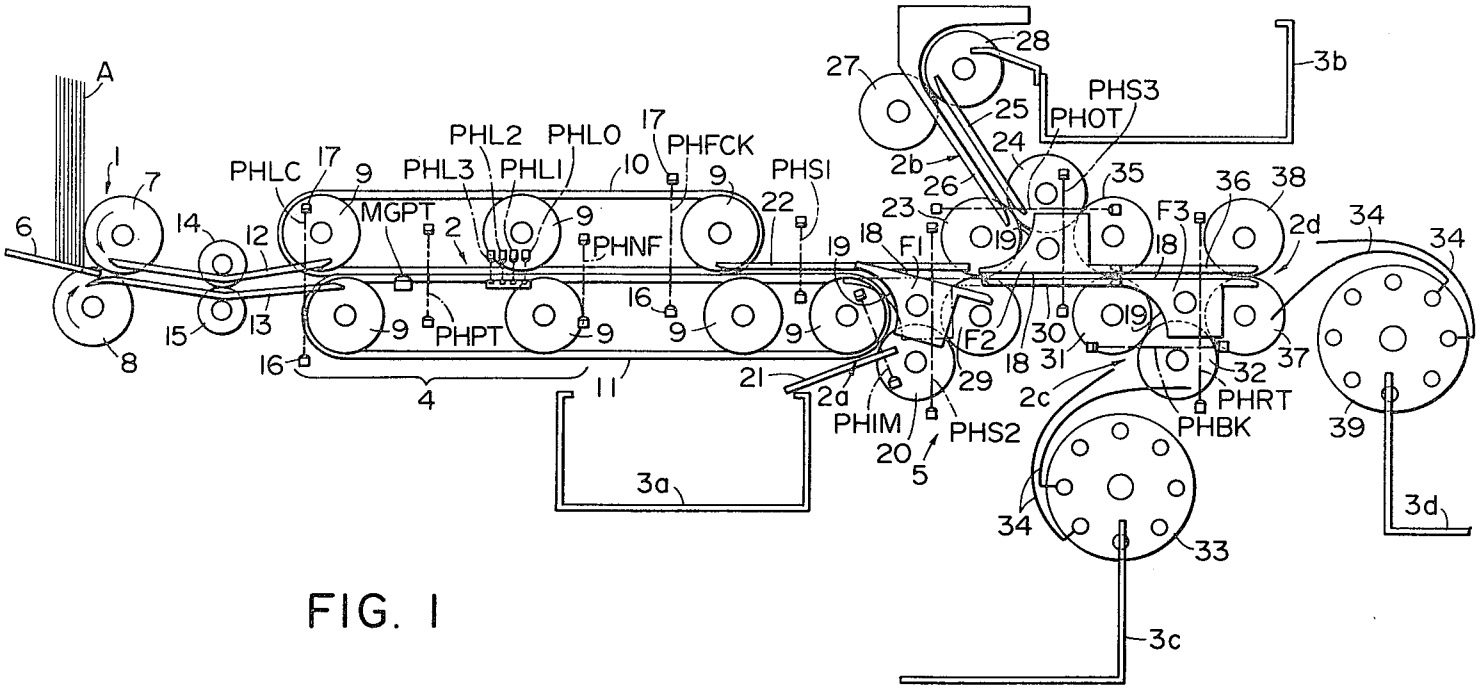
FIG. 1 is a side view showing diagrammatically the construction of the apparatus of the present invention.

One embodiment of the present invention will now be described in detail with reference to the accompanying drawings.

In the drawings, reference numeral 1 designates a feeding zone for feeding sheets of paper such as bank notes A stacked vertically to a conveyor path 2, where the bank notes A are conveyed from the left to the right as viewed in the drawing, and are selectively passed through branch conveyor paths 2*a*–2*d* branching from the conveyor path 2 at its extreme right end and are then fed into stacking zones 3*a*–3*d* each having a box-shaped or L-shaped cross-section. A discriminating zone 4 is disposed on the conveyor path 2 for discriminating the kinds of the bank notes A and a sorting zone 5 is constructed at the right-hand portion of the conveyor path 2 so as to sort out the bank notes A discriminated by the discriminating zone 4 into the respective stacking zones 3*a*–3*d*.

Next, the construction of each zone will be explained in detail. First, the feeding zone 1 comprises a pair of rollers 7 and 8 that are opposed to a support plate 6 for supporting the bank notes A and are brought into intimate contact with each other. The frictional force which accompanies the revolution of these rollers 7, 8 feeds the bank notes A one at a time with a predetermined space between them to the conveyor path 2.

The conveyor path 2 comprises a pair of belts 10 and 11 which run facing each other on a number of rollers 9 . . . and the running of these belts 10, 11 conveys the bank notes A from the left to the right. The extreme left-hand end of this conveyor path 2 is connected to the feeding zone 1 by means of a pair of guides 12 and 13 opposed to each other in the vertical direction. These guides 12 and 13 are furnished with auxiliary rollers 14 and 15, respectively.

Figure 2:
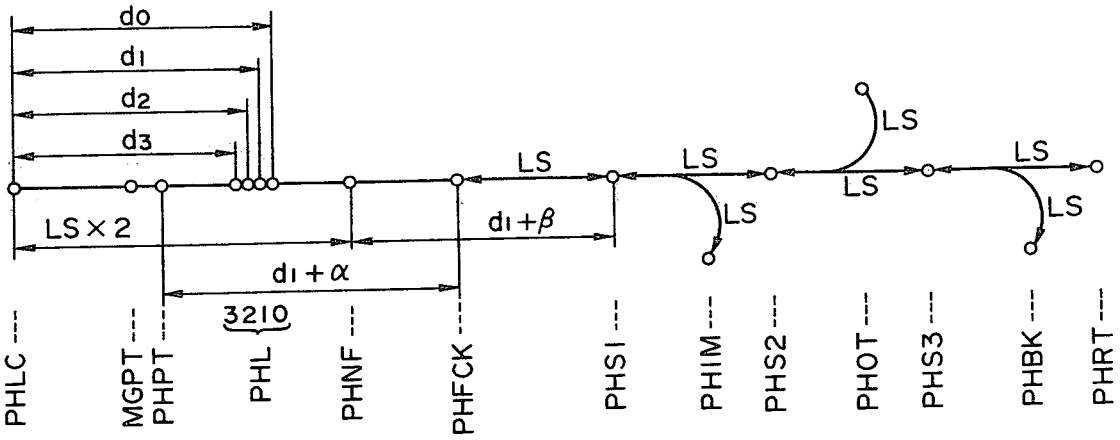
FIG. 2 is a schematic view showing the distance between the sensors.

The discriminating zone 4 disposed on the conveyor path 2 comprises a number of sensors, which may be broadly classified into the following three kinds. Namely: the sensors PHLC, PHL3–PHLO and PHNF are position detecting sensors each consisting of a light-emitter 16 and a light-receiver 17. MGPT is a sensor for detecting the magnetic pattern contained in each bank note while PHPT is a sensor for detecting the pattern of each bank note (photo-pattern). The positions of these sensors are shown in FIG. 2. In other words, the sensor PHLC is disposed at the start of the conveyor path 2, and the sensors PHL3, PHL2, PHL1 and PHL0 are disposed at positions spaced by the distances $d_3$, $d_2$, $d_1$ and $d_0$ from the sensor PHLC, respectively. The distance $d_0$ is greater than the transverse width of a 10,000-yen note, and the distance $d_1$ is greater than the transverse width of a 5,000-yen note, but is shorter than the transverse width of a 10,000-yen note while the distances $d_2$ and $d_3$ similarly correspond to the widths of 5,000-yen and 1,000-yen notes, respectively. When the bank note A is a 1,000-yen note, for example it masks simultaneously both sensors PHLC and PHL3 but not the sensors PHL2–PHL0 so that the bank note A can be discriminated as a 1,000-yen note. When the bank note A is a 5,000-yen note, it masks simultaneously both sensors PHLC and PHL2 but not the sensors PHL1 and PHL0. When the bank note A is a 10,000-yen note, further, it masks simultaneously the sensors PHLC and PHL1 but not the sensor PHL0. In this manner, the bank notes A can be discriminated in accordance with their widths. When the sensors PHLC and PHL0 are simultaneously masked, it means that the bank notes A are conveyed while they are stacked one upon another.

The sensors MGPT and PHPT are interposed between the above-mentioned sensors PHLC and PHL1 while the sensor PHNF is disposed at the position spaced by the distance 2LS from the sensor PHLC. In this instance, the symbol LS represents a distance over which the bank note A would be conveyed within a response time of a sorting fork, which will be explained later, or a distance a little greater than this distance. Incidentally, the transfer of the bank notes A by means of the aforementioned feeding zone 1 is made with a space of at least 2LS between them. In other words, the bank notes A are transferred in such a manner as to maintain a space of at least 2LS between the trailing end of a preceeding bank note A and the leading end of a subsequent bank note A. The meaning of each distance LS, 2LS will be clarified later with reference to the action of the present apparatus.

When the transfer of the bank notes A is being normally made, the trailing end of a preceding bank note A, which is ahead of a subsequent bank note A with the space of at least 2LS, has already passed by the sensor PHNF when the leading end of the subsequent bank note A arrives at the sensor PHLC, so that none of the sensors PHNF, PHL0–PHL3 are masked by the bank note A. On the other hand, when the bank notes are transferred with a space of less than 2LS between them, at least one of the sensors PHNF, PHL0–PHL3 is masked by the bank note A when the leading end of the bank note A reaches the sensor PHLC so that it is possible to check the near-feed of the bank notes A with an insufficient space between them.

Next, the sorting zone 5 will be explained. In this zone 5, three sorting forks F1, F2 and F3 are arranged adjacent one another and at substantially the same height as the conveyor path 2. These forks have the same shape, or, the same horizontal face 18 and curved face 19, and are rotated by a predetermined angle when solenoids SOL1–SOL3 are actuated on the basis of signals generated by the aforementioned discriminating zone 4, respectively. More specifically, when the solenoid SOL1 is turned on, the fork F1 is rotated clockwise whereby there is defined a first branch conveyor path 2*a* between the curved face 19 of the fork F1 and the right end portion of the belt 11, between the right end portion of the belt 11 and a roller 20, and by a guide 21, so that the bank notes A are conveyed into the first stacking zone 3*a* disposed at the end portion of the first branch conveyor path 2*a*. When the solenoid SOL1 is off and hence, the fork F1 is not rotated, the first branch conveyor path 2*a* is cut off as represented by an imaginary line in the drawing so that the bank notes A are transferred further inward through the gap between the horizontal face 18 of the fork F1 and the guide 22.

When the solenoid SOL2 is turned on, the fork F2 is rotated counter-clockwise thereby defining a second branch conveyor path 2*b* between the curved face 19 of the fork F2 and a roller 23, between the roller 23 and a roller 24 opposite thereto and by guides 15, 16 and rollers 27, 28, so that the bank notes A are fed into the second stacking zone 3*b* disposed at the end portion of this second branch conveyor path 2*b*. When the solenoid SOL2 is off, the second branch conveyor path 2 is cut off so that the bank notes A are transferred further inward through the gaps between the rollers 23 and 29 and between the horizontal face 18 of the fork F2 and the guide 30.

When the solenoid SOL3 is turned on, the fork F3 is rotated clockwise thereby defining a third branch conveyor path 2*c* between the curved face 19 of the fork F3 and a roller 31 and between the roller 31 and a roller 32 opposite thereto, so that the bank notes A are fed into the third stacking zone 3*c* via a rotary conveyor 33 disposed at the end portion of this third branch conveyor path 2*c*. This rotary conveyor 33 has a plurality of adjacent curved retaining plates 34 . . . fixed around its circumference (only two being shown in the drawing) and is allowed to rotate only counter-clockwise so as to clamp the bank notes A transferred from the third branch conveyor path 2*c* between them and to send them to the stacking zone 3*c* while rotating.

When the solenoid SOL3 is turned off, the horizontal face 18 of the fork F3 is kept horizontal whereby the third branch conveyor path 2*c* is cut off and there is defined a fourth branch conveyor path 2*d* between opposed rollers 31 and 35, the horizontal face 18 of the fork F3 and a guide 36 and between rollers 37 and 38, so that the bank notes A are fed into the fourth stacking zone 3*d* via a rotary conveyor 39 disposed at the end portion of the fourth branch conveyor path 2*d*. The rotary conveyor 39 has substantially the same construction as the aforementioned rotary conveyor 33 and feeds the bank notes A transferred from the fourth branch conveyor path 2*d* into the stacking zone 3*d* while clamping the bank notes A between their retaining plates 34 . . . and rotating clockwise.

As described above, there are disposed four stacking zones in all. The first stacking zone 3*a* stacks the bank notes that can not be identified while the second stacking zone 3*b* stacks those kinds of bank notes that are different from a set kind such as 1,000-yen notes and 5,000-yen notes with respect to 10,000-yen notes, for example. The third stacking zone 3*c* stacks those notes among a set kind of notes such as 10,000-yen notes, for example, which are transferred with their reverse side facing upward while the fourth stacking zone 3*d* stacks those which are transferred with their obverse side facing upward.

In the aforementioned sorting zone 5, there are disposed a number of sensors each consisting of a light-emitter 16 and a light-receiver 17. Hereinafter, the disposition of these sensors will be explained in detail. The sensors PHFCK and PHSI are disposed at the end portion of the conveyor path 2. More particularly, the sensor PHFCK is disposed at a position spaced apart from the sensor PHPT by a distance $(d_1+\alpha)$ which is the sum of the width $d_1$ of a 10,000-yen note and some distance $\alpha$. This arrangement enables the leading end of the bank note A to reach the sensor PHFCK after a certain period of time, which corresponds to the distance $\alpha$, has passed from the point of completion of the discrimination operation after the bank note A has passed through the sensor PHPT, as will be explained later. The sensor PHFCK is disposed upstream of the fork F1 by a distance LS. The sensor PHS1 is disposed at a position spaced apart from the sensor PHNF by a distance $(d_1+\beta)$ which is the sum of the width $d_1$ of the 10,000-yen note and some distance $\beta$ and spaced apart from the sensor PHFCK by the distance LS and moreover, immediately before the fork F1. Accordingly, the leading end of the bank note A is allowed to reach this sensor PHS1 at an instant when the time, corresponding to the distance $\beta$, has passed once the bank note A has passed the sensor PHNF.

A sensor PHIM is disposed on the first branch conveyor path 2*a* at a position spaced apart from the sensor PHS1 by the distance LS and from the sensor PHFCK by the distance 2LS. Beside the horizontal face 18 of the fork F1 is disposed a sensor PHS2 which is spaced apart from the sensor PHS1 by the distance LS and from the sensor PHFCK by a distance of at least 2LS and moreover, spaced apart from the fork F3 by a distance of at least LS in front of the fork F3. Sensors PHOT and PHS3 are disposed beside the second branch conveyor path 2*b* and beside the horizontal face 18 of the fork F2 whereby PHS3 is spaced apart from PHS2 by the distance LS and PHS1 and PHS1 by the distance 2LS. Besides the second branch conveyor path 2*b* and the horizontal face 18 of the fork F2 are disposed the sensors PHOT and PHS3 that are spaced apart from the sensor PHS2 by the distance LS and from the sensor PHS1 by the distance 2LS. Besides the third branch conveyor path 2*c* and the horizontal face 18 of the fork F3 forming the fourth branch conveyor path 2*d* are disposed sensors PHBX and PHRT that are spaced apart from the sensor PHS3 by the distance LS and from the sensor PHS2 by the distance 2LS. These sensors PHFCK, PHS1–PHS3, PHIM, PHOT, PHBK and PHRT detect the transferring position of the bank notes A and generate control signals for sorting control of the bank notes A as will be described later.

Next, the circuit construction of the apparatus of the present invention will be explained with reference to a block diagram of FIG. 3.

Figure 3:
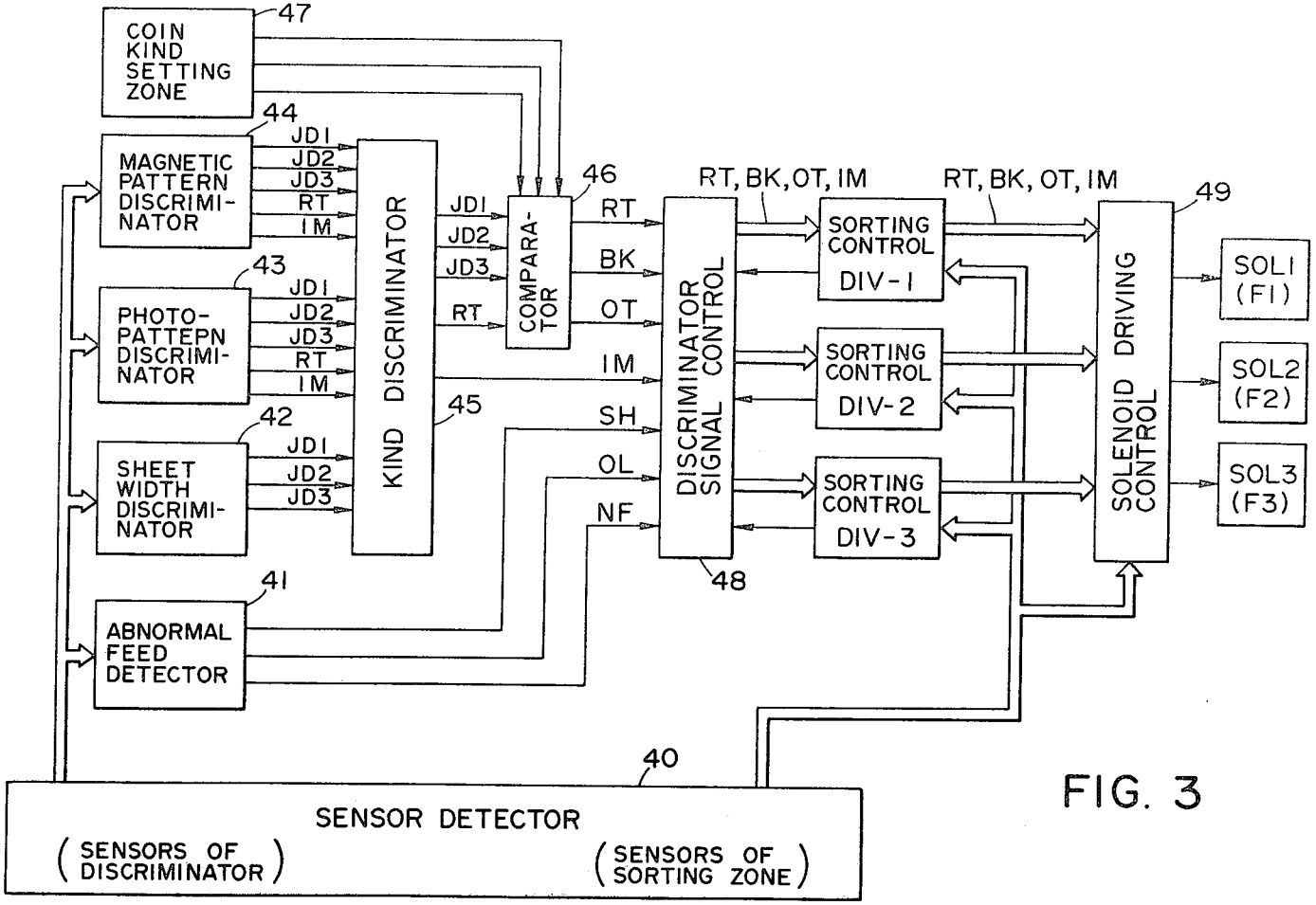
FIG. 3 is a block diagram of an electric circuit for driving the apparatus of the invention.

In FIG. 3, reference numeral 40 represents a sensor detection section which comprises all of the sensors of the afore-mentioned discriminating zone 4 and sorting zone 5.

First, when the leading end of the bank note A reaches the sensor PHLC in the discriminating zone 4, and in this case, if the preceeding bank note A masks at least one of the sensors PHL3–PHL0 and PHNF, an abnormal feed detecting section 41 receives detection signals from these sensors and feeds as an output a near-feed signal NF to a discrimination signal controlling section 48. When the leading end of the bank note A subsequently reaches the sensor MGPT, a detection signal is fed to a magnetic pattern discriminating section 44. At the point when the trailing end of the bank note A passes the sensor MGPT, this discriminating section 44 delivers a signal, representative of the result of the discrimination, to a notekind discriminating section 45. In other words, when the bank note A is a 10,000-yen note, for example, an output JD1 is produced. Likewise, output signals JD2 and JD3 are produced when the bank note is a 5,000-yen note and a 1,000-yen note, respectively, and when the kind of note is unidentifiable, a signal IM is produced as the output. If the signal is one of the signals JD1, JD2 and JD3 and moreover, if the obverse side of the bank note A faces upward, a signal RT is produced together with the abovementioned signal. The signal RT is not produced when the reverse side of the bank note A faces upward.

When the bank note A then reaches the sensor PHPT, the detection signal of the sensor PHPT is transmitted to the photo pattern discriminating section 43 in the same way as above and the signals JD1, JD2, JD3, IM and RT representative of the result of discrimination in this discriminating section 43 are delivered to the note-kind discriminating section 45. When the trailing end of the bank note A passes by the sensor PHLC and when, at that point, none of the sensors PHL3–PHL0 are masked by the bank note, the abnormal feed detecting section 41 delivers a short-width signal SH to the discrimination signal controlling section 48.

If the sensor PHLC and PHL3–PHL1 are simultaneously masked by the bank note A, one of the signals JD1, JD2 and JD3 is delivered from the note-width discriminating section 42 to the note-kind discriminating section 45 at the point where the bank note A passes by the sensor PHLC. Further, if the sensors PHLC and PHL0 are simulaneously masked, the abnormal feed detecting section 41 delivers an overlap-feed signal OL to the discrimination signal controlling section 48. The note-kind discriminating section 45 is applied with the discrimination signals JD1, JD2, JD3, IM and RT. When one of the signals JD1, JD2 and JD3 coincide with the signal from the three discriminating sections 42, 43 and 44 and with the RT signal, which may or may not be present, the note-kind discriminating section 45 delivers one of the signals JD1, JD2 and JD3 to a comparing section 46 and selectively outputs the RT signal. When the signals impressed as the input upon the note-kind discriminating section 45 do not coincide, or when the unidentifiable signal IM is applied as the input from either one of the discriminating sections 43 and 44, the signal IM is delivered from the notekind discriminating section 45 to the discriminating signal controlling section 48.

Next, the comparing section 46 compares the signals JD1, JD2, JD3 and RT applied at the input from the note-kind discriminating section 45 with a set signal from a note-kind setting section 47. If the set notekind signal of the bank note is JD1, for example, it delivers as its output a correct-note obverse side signal RT, during the time when it is provided with the signals JD1 and RT from the note-kind discriminating section 45, to the discrimination signal controlling section 48. When it is provided with the signal JD1 from the note-kind discriminating section 45 but not with the signal RT, the comparing section 46 produces as its output a correct-note (reverse side) signal BK. When applied with the signals JD2 and JD3 from the note-kind discriminating section 45, the comparing section 46 produces as its output a different note-kind signal OT irrespective of the absence or presence of the signal RT.

Incidentally, to the discrimination signal controlling section 48 are sequentially applied the signals NF, SH, OL, RT (or BK and OT) in the order named. The signal IM may be preferentially delivered when it is obtained from the discriminating section 42, 43 or may be delivered simultaneously with the signal RT (or BK, OT). Upon receiving the abovementioned seven kinds of input signals, the discrimination signal controlling section 48 delivers a control signal to one of three sorting sections DIV1–DIV3 in accordance with the seven kinds of signals. In other words, when receiving the signals RT, BK, OT and NF, this discrimination signal controlling section 48 produces as its output the signals RT, BK, OT and NF corresponding to the input signals, respectively. When provided with the signals IM, SH and OL, the controlling section 48 produces as its output the signal IM. This signal is sequentially delivered to the sorting sections DIV1–DIV3 in accordance with the bank notes A to be transferred.

In other words, the signal for a preceding bank note A is first delivered to the sorting controlling section VID-l, the signal for a subsequent bank note A to the sorting controlling section DIV-2 and the signal for a further subsequent bank note A to the sorting controlling section DIV-3. Three sorting controlling sections are used for this invention because a maximum of three bank notes can be transferred simultaneously from the sensor PHLC to the sensor PHRT or PHBK. These controlling sections DIV1–DIV3 deliver a driving signal to a solenoid drive controlling section 49 in accordance with the discrimination signals applied thereto as input. In other words, when applied with the signal RT, they provide a signal RT to the solenoid drive controlling section 49, thereby turning off all solenoids SOL-1–SOL3. This state is hereinafter called the step RT. When provided with the signal BK, they deliver the signal BK, thereby turning off the solenoids SOL1 and SOL2 and turning on the solenoid SOL3. Hereinafter, this state is called the step BK. When provided with the input signal OT, they produce an output signal OT, thereby turning off the solenoid SOL1 and turning on the solenoid SOL2. In this instance, the solenoid SOL3 remains in the operative state corresponding to the preceding bank note, that is, either in the ON or OFF state, and is not changed over. Hereinafter, this state is called the step OT. When supplied with the input signal IM, they produce an output signal IM, thereby turning on the solenoid SOL1. In this instance, the solenoids SOL2 and SOL3 remain in the previous operative state. Hereinafter, this state is called the step IM.

When the signal NF is applied as the input to the discrimination signal controlling section 48, the sorting controlling sections DIV1–DIV3 operate in the following manner. If the sorting controlling section such as DIV-l, for example, is about to perform the steps RT, BK for a preceding bank note A, this controlling section DIV-1 is changed over to the step OT by means of the signal from the discrimination signal controlling section 48 and delivers the signal OT to the solenoid driving section 49. If this controlling section DIV-1 is about to perform the step OT, it remains in such state. When DIV-1 performs the step OT in this manner, the controlling section DIV-2 for a subsequent bank note A also performs the same step OT. If the controlling section DIV-1 for the preceding bank note is about to perform the step IM, the controlling section DIV-1 remains in the state of such a step and the controlling section DIV-2 for the subsequent bank note also performs the step IM. In this way, the controlling sections perform the specific action when the signal NF is applied as the input signal to the discrimination signal controlling section 48. In other words, when a space between the preceding bank note and the subsequent bank note is less than 2LS, the fork is locked in order to prevent the occurrence of the catching by the fork, which will be described later in detail. Therefore, there would be the possibility that it is impossible to sort the notes into the different branch paths and that the subsequent note is fed ito the same branch path into which the preceding note has been fed. Further, since the conveyor path is short for waiting for output of discriminating result of the subsequent note, the step for preceding the preceeding note and the subsequent note is changed over to carry out the step OT at the time of output of the near-feed signal NF. Therefore, the preceding note and the subsequent note are fed into the branch path *2b*. When the preceding note carries out the step IM, the subsequent note is changed over to carry out the step IM.

Check signals are outputted from the sensor detecting section 40 to the abovementioned sorting controlling sections DIV1–DIV3. In other words, the signals to check the passage of the bank notes are delivered from the sensors PHFCK, PHS1–PHS3, PHIM, PHOT, PHBK and PHRT of the sorting zone 5 to the controlling sections DIV1–DIV3 corresponding to the bank notes so that check can be made for the transfer and sorting in accordance with each bank note. The controlling sections DIV1–DIV3 are reset by the signals from these sensors at the point when the bank note has passed the sensors PHIM, PHOT, PHBK and PHRT and prepare for the bank notes to be subsequently transferred.

Signals for controlling the solenoid operation are also delivered from the sensor detecting section 40 to the solenoid drive controlling section 49. Namely, since the forks F1–F3 require a considerable period of time for their response, they must start response by the time when a bank note reaches a position spaced apart from them by the distance LS which corresponds to the response time. If they start responding when the bank note is at a position closer than LS, they would catch the bank note. If the forks F1–F3 start responding during the passage of the bank note through them, they would similarly catch it. Accordingly, a control signal is sent to the solenoid drive controlling section 49 during the passage of the bank note through the sensors PHFCK, PHS1, PHIM and PHS2 so as to inhibit the ON-OFF change of the solenoid SOL1 and to restrict the rotation of the fork F1, thereby preventing the occurrence of the abovementioned catching phenomenon. Similarly, the ON-OFF change of the solenoid SOL2 is inhibited during the passage of the bank note through the sensors PHS1, PHS2, PHS3 and PHOT, and that of the SOL3 is inhibited during the passage of the bank note through the sensors PHS2, PHS3, PHBK and PHRT.

To give an example, it will now be assumed that when a preceding bank note is undergoing the step RT and passing near the fork F2, for instance, a subsequent bank note reaches the sensor PHFCK and is about to undergo the step BK. Since the preceding bank note is passing through the sensor PHS2 or PHS3, it is not possible to perform the step BK. In this case, the step BK is carried out for the subsequent bank note at the point when the preceding bank note has passed the sensor PHRT, whereupon the fork F3 is allowed to rotate.

The action of the apparatus having the abovedescribed construction will be explained. The explanation is first had with respect to the case where 10,000-yen notes as the set kind of notes, for example, are normally conveyed with their obverse side upward and with the space of at least 2LS between them. Upon receiving the detection signals from the sensors PHLC and PHLl, the note-width discriminating section 42 delivers the signal JD1. When the note pass the MGPT and PHPT, the respective discriminating sections 42 and 43 deliver the signals JD1 and RT and the note-kind discriminating section 45, which receives the signals from these discriminating sections 42, 43 and 44, delivers the signals JD1 and RT. Upon receiving these signals, the comparing section 46 delivers the signal RT to the discrimination signal controlling section 48, which in turn sends the signal RT to the sorting controlling section e.g., DIV-1, thereby allowing it to perform the step RT. In this instance, all the solenoids SOL1–SOL3 are turned off and the horizontal faces 18 of all the forks F1–F3 become horizontal so that the bank notes A are fed by the rotary conveyor 39 into the fourth stacking zone *3d* past through the fourth branch conveyor path *2d*. At this time, the bank notes or the 10,000-yen notes, are turned over with their reverse sides facing upward. The 10,000-yen notes thus stacked are then bundled every 100 notes by means of a bundling device not shown.

Next, when the 10,000-yen notes are being normally conveyed with their reverse sides facing upward and with the normal distance of at least 2LS between them, the note-width discriminating section 42 delivers the signal JD1 due to the detecting action of the sensors PHLC and PHLl. When the bank notes have passed MGPT and PHPT, the respective discriminating sections 44 and 43 produce the signal JD1 but not the signal RT. Upon receiving the signal, the note-kind discriminating section 45 delivers the signal JD1 but not the signal RT. The comparing section 46 which receives only the abovementioned signal JD1 delivers the signal BK to the discrimination controlling section 48, which in turn sends the signal BK to the sorting controlling section DIV-2 (it is hereby assumed that a preceding bank note is subjected to the sorting control by the DIV-1), so that the sorting controlling section DIV-2 performs the step BK.

In this case, the solenoids SOL1 and SOL2 are turned off and only the solenoid SOL3 is turned on. Hence, the horizontal face 18 of the forks F1 and F2 becomes horizontal and only the fork F3 is rotated clockwise due to the excitation of the solenoid SOL3, thereby closing the fourth branch conveyor path *2d* and opening the third branch conveyor path *2c*. Accordingly, the bank notes A are transferred into the third stacking zone *3c* by means of the rotary conveyor 33 through the third branch conveyor path *2c*. In this case, the bank notes, or the 10,000-yen notes, are stacked with their reverse sides facing upward. The 10,000-yen notes stacked in this manner are bundled every 100 notes.

Next, when the bank notes of different kinds such as 5,000-yen notes and 1,000-yen notes are conveyed, the note-width detecting section 42 delivers the signal JD3 or JD2 due to the detecting action of the sensor PHL2 or PHL3. When the bank notes have passed the sensors MGPT and PHPT, the discriminating sections 44 and 43 produce the signal JD2 or JD3 and the signal RT. (The signal RT is produced only when the obverse side of the bank note faces upward.) Upon receiving these signals from the discriminating sections 42, 43 and 44, the notekind discriminating section 45 outputs the signal JD2 or JD3 and the signal RT to the comparing section 46, which in turn delivers the signal OT. Upon receiving this signal OT, the discrimination signal controlling section 48 sends the signal OT to the sorting controlling section DIV-3 (it is hereby assumed that the preceding bank note is subjected to the sorting control by the DIV-2), thereby performing the step OT. Since the solenoid SOL1 is turned off and the solenoid SOL2 is turned on in this case, the horizontal face 18 of the fork F1 becomes horizontal while the fork F2 rotates counterclockwise, thereby closing the third and fourth branch conveyor paths *2c* and *2d* and opening the second branch conveyor path *2b*. In consequence, the bank notes, that is, the 5,000-yen and 1,000-yen notes, are transferred into the second stacking zone *3b* through this second branch conveyor path *2b*.

During this step OT, the solenoid SOL3 remains in the operative state corresponding to the preceding bank note and is not subjected to the ON-OFF change control. Hence, the fork F3 remains in the previous operative state.

When the bank notes are conveyed while being folded, PHL3–PHL0 are not masked even if the bank notes pass the sensor PHLC so that the abnormal feed detecting section 41 delivers the short-width signal SH to the discrimination signal controlling section 48. At the point when the bank notes pass the sensors MGPT and PHPT, the discriminating sections 44 and 43 send the unidentifiable signal IM to the note-kind discriminating section 45, which in turn sends the signal IM to the discrimination controlling section 48. Upon receiving these signals SH and IM, the discrimination signal controlling section 48 delivers the signal IM to the sorting controlling section such as DIV-1, for example, so that the DIV-1 performs the step IM. In this case the solenoid SOL1 is turned on and the fork F1 rotates clockwise, thereby opening the first branch conveyor path *2a* and closing the other branch conveyor paths *2b*, *2c* and *2d*. In consequence, the bank notes are transferred into the first stacking zone *3a* past through this first branch conveyor path *2a*. During this step IM, the solenoids SOL2 and SOL3 as well as the forks F2 and F3 remain in the active state corresponding to the preceding bank note.

When the bank notes are conveyed while being overlapped, the abnormal feed detecting section 41 delivers the overlap feed signal OL to the discrimination signal controlling section 48 due to the detecting actions of the sensors PHLC and PHL0. Due to the detecting actions of the sensors MGPT and PHPT, further, the discriminating sections 44 and 43 output the signal IM to the note-kind discriminating section 45, which in turn sends the signal IM to the discrimination signal controlling section 48. The subsequent operations are the same as those in the case of the folded transfer of the bank notes. If bills other than the bank notes are conveyed, they are likewise fed into the first stacking zone *3a*.

Next, explanation will be had with respect to the case where the preceding bank note and the subsequent bank note are conveyed with a space of not greater than 2LS between the trailing end of the former and the leading end of the latter. In the case of this near-feed, one of the sensors PHL3–PHL0 and PHNF is masked by the preceding bank note at the time when the subsequent bank note reaches the sensor PHLC. Upon detecting this condition, the abnormal feed detecting section 41 sends the near-feed signal NF to the discrimination signal controlling section 48. If the sorting controlling section such as DIV-1, for example, is about to perform the steps BK and RT for the preceeding bank note in this case, this controlling section DIV-1 is changed over to the step OT by means of the signal OT from the discrimination signal controlling section 48 which receives the abovementioned NF signal. The output signal OT is also impressed upon the sorting controlling section DIV-2 which is to act in response to the subsequent bank note so that this DIV-2, too, performs the step OT. Accordingly, both preceding and subsequent bank notes are transferred into the second stacking zone *3b*. When the controlling section DIV-1 is about to perform the step OT, DIV-1 is not changed over and the signal OT is also applied as the output to the DIV-2 to make it execute the step OT. Hence, both bank notes are transferred to the second stacking zone *3b*. When the controlling section DIV-1 is about to perform the step IM for the preceding bank note, the DIV-1 remains in the state of the step IM and the output signal IM is also impressed upon the controlling section DIV-2. Hence, both bank notes are fed into the first stacking zone *3a*.

Though the bundling device (not shown) is interlocked with the apparatus of the invention in the embodiment so far described, the present invention is not particularly restricted to such an arrangement. Hence, the bundling device may of course be deleted.

In the aforementioned embodiment, it is also possible to add a mechanism for detecting the bank notes when they are slantly conveyed. In other words, the abovementioned embodiment is equipped with one each sensor PHLC, PHL0–PHL3. However, these sensors may be disposed two each on the right and left along the conveying direction, respectively, to detect the difference of the time required for the bank note to pass through the pair of sensors so that if the time difference exceeds a set time, the abnormal feed detecting section 41 generates a slant-feed signal, thereby to perform the step IM, and if it is within the set time, the processing is made as in the case of normal feed.

As described above, the apparatus of the present invention distinguishes the bank notes of a set kind from those of different kinds and sorts them out, respectively. At the same time, the apparatus also discriminates between the obverse and reverse side of the bank notes of the set kind. In confirming manually the bank notes thus sorted out and stacked, therefore, counting can be made while merely confirming the same pattern either on the obverse or the reverse side of the bank notes. Hence, the sorting work can be simplified and the efficiency enhanced. When it is desired to bundle the bank notes with their sides arranged front-to-back, bundling can be made while the bank notes are as-stacked by the apparatus. This eliminates the manual confirmation and increases the efficiency of the sorting work.

What is claimed is:

1. An apparatus for processing sheets which comprises:

means for feeding sheets one at a time from a stack of sheets;

conveyor means for receiving the sheets from said feeding means and for moving the sheets along a conveyor path;

detecting means comprising a plurality of sensors disposed in said conveyor path for detecting widths of the sheets and for generating signals representative of the sensed widths, for detecting whether the obverse side of the sheet is up and for generating a signal indicative of the sensed sheet side, and for detecting a sheet that cannot be discriminated and for generating a signal indicative of the sheet indiscrimination;

discriminating means electrically associated with said detecting means for discriminating the sheets into a plurality of groups, one group having sheets of a set kind with the obverse side up, another group having sheets of the set kind with the reverse side up, a third group having sheets of different kinds, and a fourth group having sheets that cannot be discriminated, and for generating signals indicative of said groups in response to a combination of signals from said detecting means;

sorting means disposed downstream of said detecting means in said conveyor path for sorting the sheets into said groups of sheets in response to said signals from said discriminating means; and stacking means for stacking the sheets sorted by said sorting means.

2. An apparatus as set forth in claim 1, wherein said detecting means includes a magnetic-pattern sensor for sensing widths of the sheets, whether the obverse side of the sheet is up, and sheets that cannot be discriminated.

3. An apparatus as set forth in claim 1, wherein said detecting means includes a photo-pattern sensor for sensing widths of the sheets, whether the obverse side of the sheet is up, and the sheets that cannot be discriminated.

4. An apparatus as set forth in claim 1, wherein said detecting means includes position-detecting sensors for sensing widths of the sheets.

5. An apparatus as set forth in claim 4, further including abnormal feed-detecting means for detecting abnormal feed condition of the sheet in response to signals generated from said position-detecting sensors.

6. An apparatus as set forth in claim 1, wherein said detecting means includes a magnetic-pattern sensor, a photo-pattern sensor and position-detecting sensors, and said discriminating means discriminates the sheets into said groups of sheets in response to a combination of signals generated from said magnetic-pattern sensor, photo-pattern sensor and position-detecting sensors.

7. An apparatus as set forth in claim 1, wherein said sorting means includes three forks angularly rotatable for sorting the sheets into said groups of sheets.

* * * * *